US007908710B2

(12) United States Patent
Monneret et al.

(10) Patent No.: US 7,908,710 B2
(45) Date of Patent: Mar. 22, 2011

(54) DEVICE FOR ARTICULATING A COVER OR LID TO A FRAME IN PARTICULAR OF A MANHOLE

(75) Inventors: Jean-Jacques Monneret, Lyons (FR); Christian Fumalle, Butry (FR)

(73) Assignee: Norinco, Saint Crepin Ibouvillers (FR)

( * ) Notice: Subject to any disclaimer, the term of this patent is extended or adjusted under 35 U.S.C. 154(b) by 0 days.

(21) Appl. No.: 11/995,733

(22) PCT Filed: Jul. 26, 2006

(86) PCT No.: PCT/FR2006/001826

§ 371 (c)(1),
(2), (4) Date: Mar. 4, 2008

(87) PCT Pub. No.: WO2007/012758

PCT Pub. Date: Feb. 1, 2007

(65) Prior Publication Data

US 2008/0209680 A1 Sep. 4, 2008

(30) Foreign Application Priority Data

Jul. 27, 2005 (FR) ..... 05 52334

(51) Int. Cl.
*E05D 11/00* (2006.01)

(52) U.S. Cl. ..... 16/260; 16/266; 220/326; 404/25

(58) Field of Classification Search ..... 16/260, 16/254, 229, 231, 252, 382, 266, 342, 374; 404/25; 220/326

See application file for complete search history.

(56) References Cited

U.S. PATENT DOCUMENTS

| | | | | | |
|---|---|---|---|---|---|
| 2,529,329 | A * | 11/1950 | De Frees | 220/203.24 |
| 3,179,285 | A * | 4/1965 | De Frees | 220/89.4 |
| 3,199,285 | A * | 8/1965 | Montese-Caruso et al. | 368/276 |
| 3,344,947 | A * | 10/1967 | Gallup | 220/314 |
| 4,137,669 | A * | 2/1979 | Nunlist | 49/386 |
| 4,302,126 | A * | 11/1981 | Fier | 404/26 |
| 4,584,739 | A * | 4/1986 | Konen | 16/266 |
| 4,729,134 | A * | 3/1988 | Hillebrand et al. | 4/236 |
| 4,840,514 | A * | 6/1989 | Defrance et al. | 404/25 |
| 5,366,317 | A * | 11/1994 | Solimar | 404/25 |
| 6,481,055 | B2 * | 11/2002 | Cheng | 16/252 |
| 6,591,467 | B2 * | 7/2003 | Cardona | 29/11 |
| 6,595,716 | B1 * | 7/2003 | VanDeVyvere et al. | 404/26 |
| 6,701,573 | B1 * | 3/2004 | Ciavarella et al. | 16/266 |
| 6,749,363 | B1 * | 6/2004 | Petersen | 404/25 |
| 6,834,416 | B2 * | 12/2004 | Wang et al. | 16/266 |
| 6,840,785 | B2 * | 1/2005 | Drane | 439/138 |
| 7,160,051 | B1 * | 1/2007 | Cuny et al. | 404/25 |
| 7,178,292 | B2 * | 2/2007 | Yamada | 49/193 |
| 2010/0178105 | A1 * | 7/2010 | Monneret | 404/25 |

FOREIGN PATENT DOCUMENTS

| | | | |
|---|---|---|---|
| FR | 2627468 | A1 * | 8/1989 |
| FR | 2695951 | A1 | 3/1994 |
| GB | 2328970 | A | 9/1998 |

* cited by examiner

*Primary Examiner* — Daniel P Stodola
*Assistant Examiner* — Rowland D Do
(74) *Attorney, Agent, or Firm* — Leydig, Voit & Mayer, Ltd.

(57) ABSTRACT

A device for articulating a stopper or lid to a frame, in particular of a man hole. The male articulating member may optionally be mounted either removably in its housing of the frame to enable the stopper to be extracted from the frame in its upright position or secured in its housing such that the stopper is not detachable from the frame.

5 Claims, 3 Drawing Sheets

DEVICE FOR ARTICULATING A COVER OR LID TO A FRAME IN PARTICULAR OF A MANHOLE

FIELD OF THE INVENTION

The present invention relates to a device for articulating a cover or lid to a frame in particular of a manhole.

BACKGROUND

A device of this type is known, which enables the cover to adopt a position for sealing or closing the frame, or an open position in which the cover is upright so as to allow an operator to access the manhole.

This articulation device includes a male component connected to the cover and mounted with limited pivoting in a housing made in the frame.

The cover can be locked to the frame by a latch placed on the opposite side from the articulation.

However, this device presents a major drawback in that when in the upright position for opening the cover, it can be extracted from the frame by malicious persons.

In order to solve this problem, locking means of the lock type have been associated with the articulation in order to connect the cover to the frame permanently.

However, these means have a complex structure and increase the manufacturing costs of the articulation device.

SUMMARY OF THE INVENTION

The present invention aims to eliminate the aforementioned drawbacks by proposing a device for articulating a cover or lid to a frame in particular of a manhole, which enables the cover to adopt a position for sealing the frame, or an open position in which it is upright so as to allow access to the opening of the frame and including a male component connected with the cover and mounted with limited pivoting in a housing made in the frame, characterized by the fact that the male component of the articulation can be, as desired, either mounted in a removable manner in its housing of the frame in order to allow the cover to be pulled off the frame when in its upright position, or connected in its housing of the frame so that the cover cannot be removed from its frame.

Preferably, the male articulation component includes a cylindrical barrel set in the housing of the frame configured in the form of a clevis, making it possible to support a hinge pin which passes through the cylindrical barrel and can be attached in a tamper-proof manner to the clevis in order to make it so that the cover cannot be removed from its frame.

The diameter of the hinge pin is smaller than the diameter of the bore of the cylindrical barrel through which this pin passes, where the ends of the pin are attached, for example by welding, respectively to the two parallel walls of the clevis.

The cylindrical barrel has means for holding the cover in its upright position.

The holding means advantageously includes two stubs connected to the ends of the cylindrical barrel perpendicularly to it and which can engage by gravity, when the cover is in the upright position, respectively in two recesses in the bottom of the housing of the frame.

When the cover and the frame are circular, the cylindrical barrel is attached to the cover by a radial projecting piece in such a way that the barrel and the projecting piece have a T-shaped configuration.

The cover occupies an upright open position of approximately 90° relative to the frame.

BRIEF DESCRIPTION OF DRAWING FIGURES

The invention will be better understood and its other objectives, characteristics, details and advantages will appear more clearly in the following explanatory description in reference to the drawings given only by way of example illustrating an embodiment of the invention and in which:

FIG. 3 is an enlarged perspective view similar to that of FIG. 2 and representing only the housing of the frame which makes it possible to receive the articulation of the invention;

DETAILED DESCRIPTION

In reference to the figures, reference 1 designates a frame which has a generally circular shape and on which cover or lid 2, also circular, is articulated, where it is understood that frame 1 and cover 2 may be of different shapes, for example, rectangular or square.

Frame 1 is intended to be sealed in the pavement so as to constitute, with cover 2, a manhole.

Figure 1:
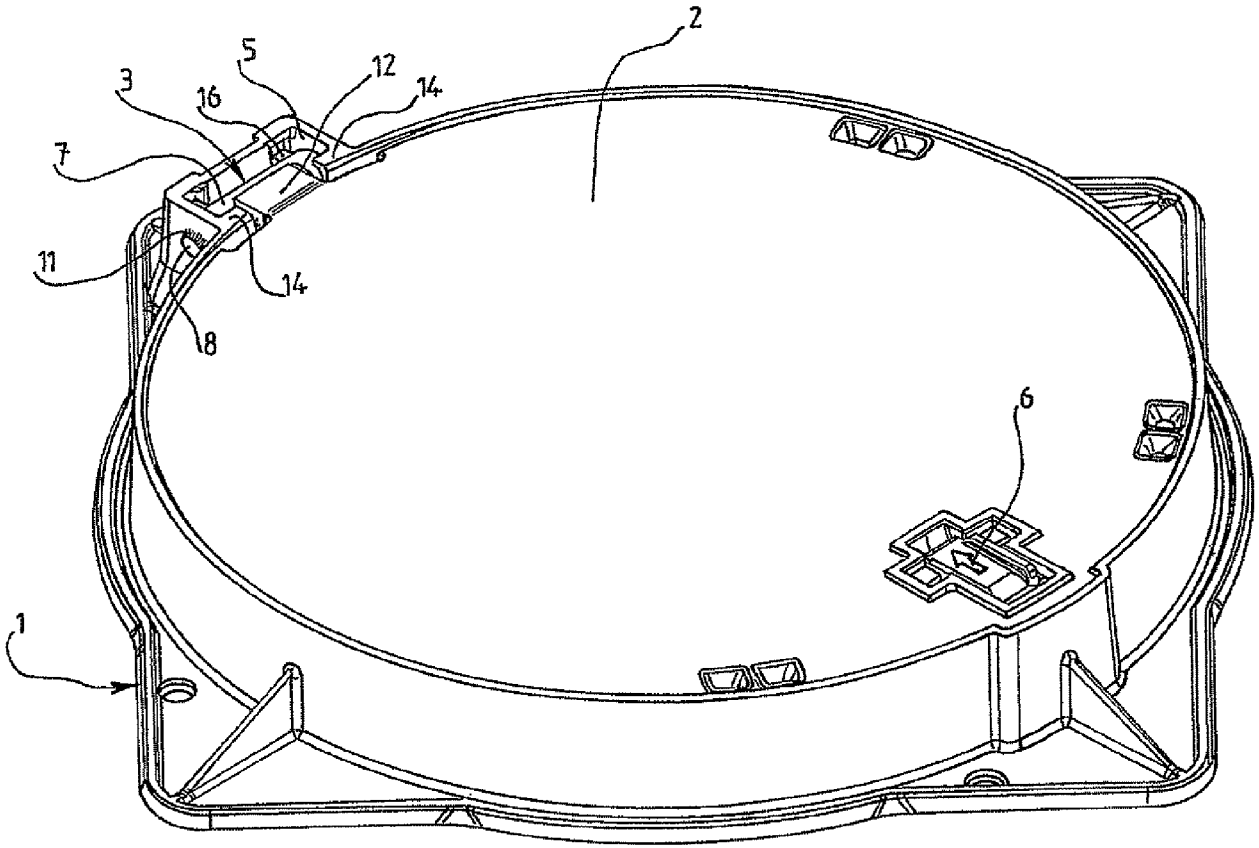
FIG. 1 is a perspective view of a manhole cover and frame assembly with the cover articulated to the frame according to the invention.
Figure 1:
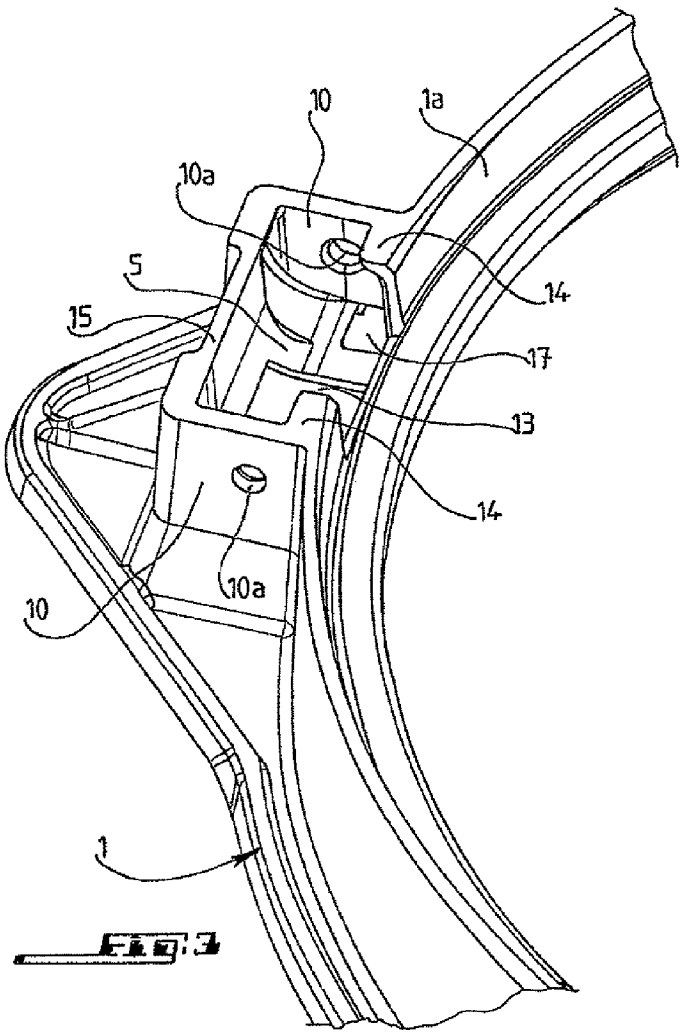

Articulation 3 allows cover 2 to adopt a position for sealing or closing of frame 1 represented in FIG. 1 or an open position, not represented, in which cover 2 is upright in a determined angular position relative to the frame in order to allow an operator to access the manhole through the opening of frame 1.

As is known in itself, articulation 3 includes male component 4 connected to cover 2 and mounted with limited pivoting or rotation in housing 5 arranged in frame 1.

FIG. 1 also shows that cover 2 is provided with latch 6, known in itself, diametrically opposite from articulation 3 and allowing one to lock cover 2 to frame 1 in its closed position.

According to the invention, male articulation component 4 may as chosen be either mounted in a removable manner in its housing 5 of frame 1 to allow cover 2, if desired, to be pulled off frame 1 in its upright position, or to be connected in its housing 5 so that cover 2 cannot be disassembled from frame 1.

Thus, articulation 3 of the invention, with the same cast elements, can as chosen be made part of the frame so that cover 2 cannot be disassembled, or attached in a removable manner in its housing 5 of frame 1 to allow cover 2 to he pulled off the frame.

To this end, male articulation component 4 includes cylindrical barrel 7 set in housing 5 of frame 1, housing which is configured in the form of a clevis for support of hinge pin 8 which goes freely through longitudinal bore 9 of barrel 7 and is attached in a tamper-proof manner to the clevis of housing 5.

Figure 2:
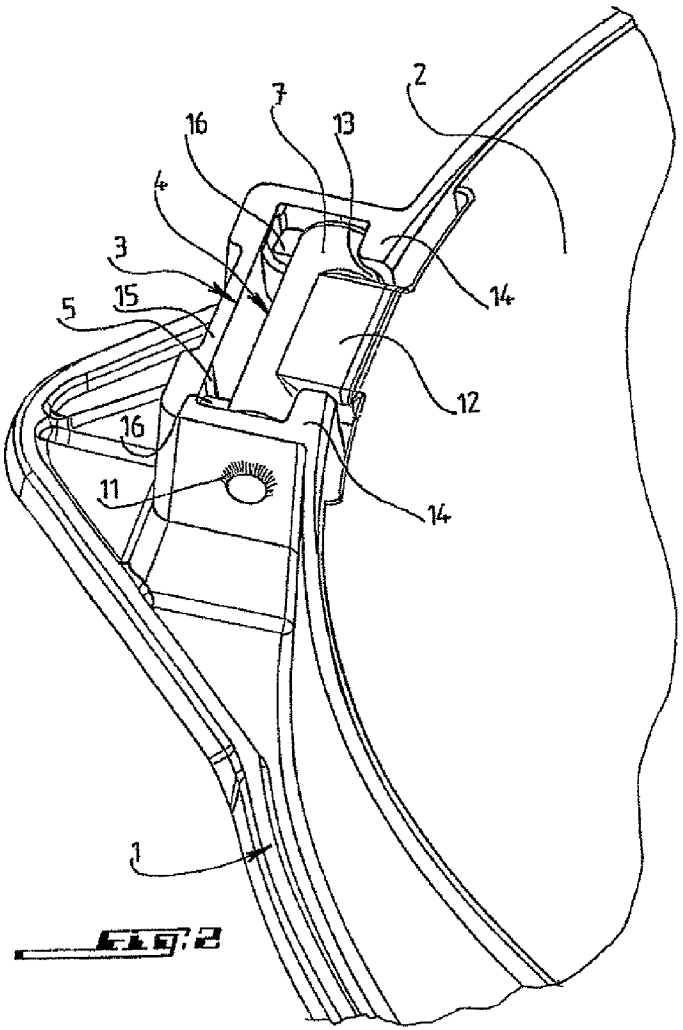
FIG. 2 is an enlarged perspective view of the articulation of the invention which allows attachment of the cover to the frame.
Figure 5:
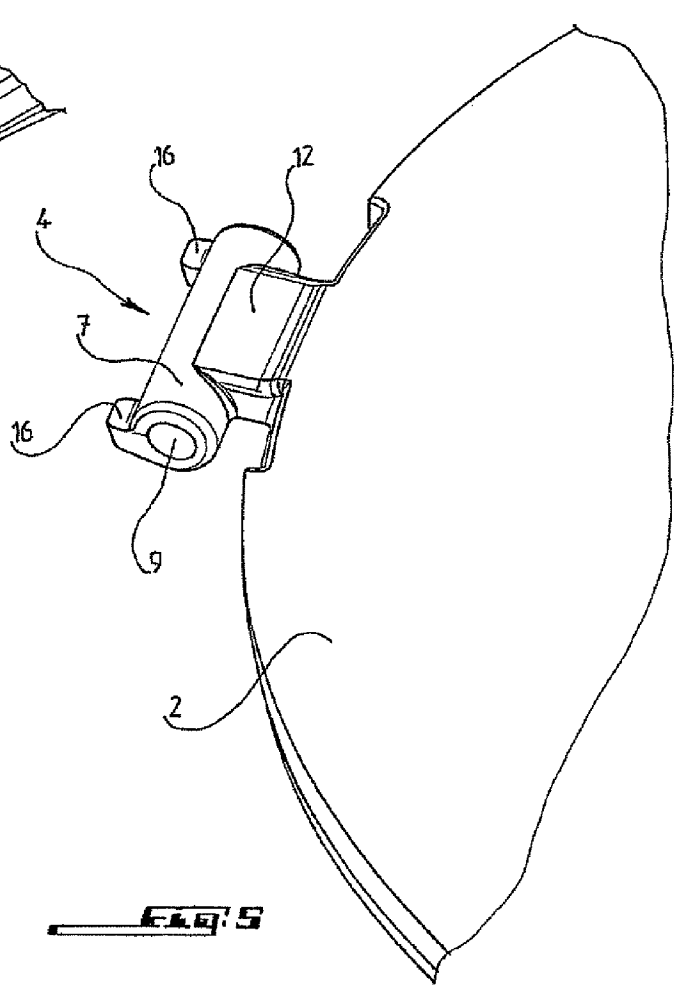
FIG. 5 is an enlarged perspective view of a part of the cover with the male articulation component.
Figure 4:
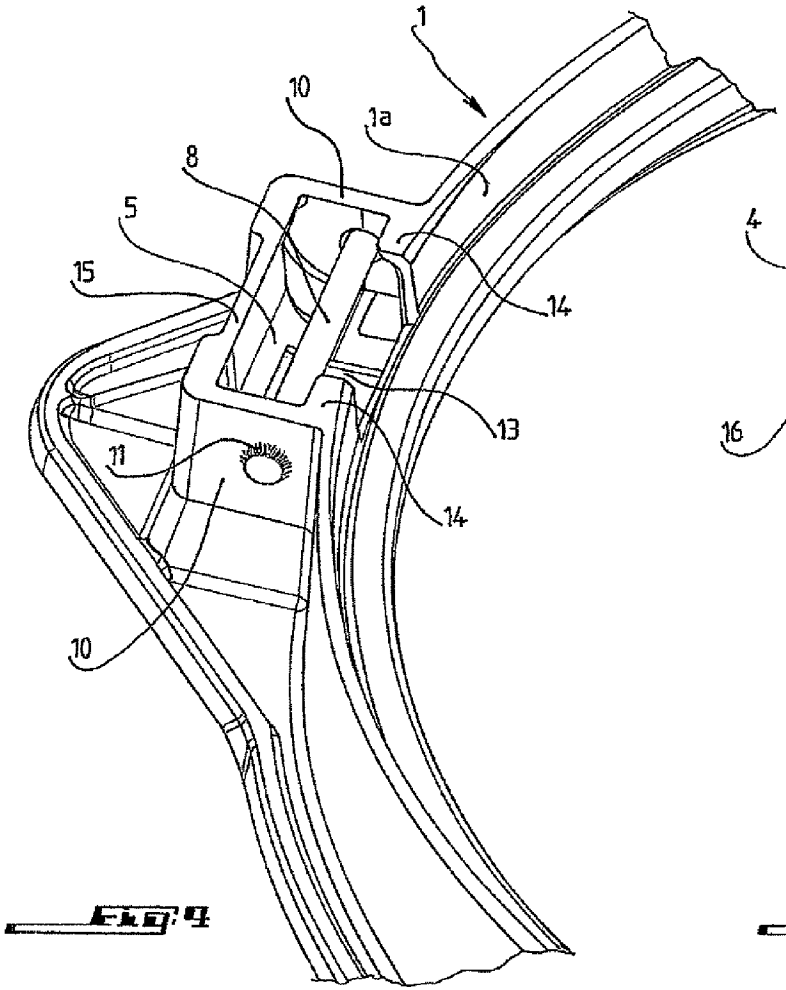
FIG. 4 is an enlarged perspective view similar to that of FIG. 3 and showing also a hinge pin which passes through the housing of the frame.

More precisely, the clevis of housing 5 is defined by two essentially parallel walls 10 externally connected to circular peripheral rim 1*a* of frame 1 in which cover 2 is set. Each wall 10 is thus situated in the extension of a chord of frame 1. Hinge pin 8 goes through holes 10*a* in each of walls 10, which are perpendicular to the hinge pin 8, and ends of the hinge pin 8 are connected to the respective walls 10. For example, each end of hinge pin 8 is connected by welding to the external side of wall 10 as indicated at 11 in FIGS. 2 and 4. Male component 4 of articulation 3 also has projecting piece 12 connected radially to cover 2 and which can engage, in the closed position of cover 2, in opening 13, which is delimited between two circumferentially spaced walls 14 in extension of rim 1*a* of frame 1 and delimiting, with walls 10 and their connecting external wall 15, housing 5 for male articulation element 4. Thus, the latter has a T-shaped general configuration.

The diameter of bore 9 of barrel 7 is larger than the diameter of hinge pin 8.

Cylindrical barrel 7 has two stubs 16 respectively connected to both ends of barrel 7 perpendicularly to its longitudinal direction, protruding on the same side and situated approximately in the same longitudinal median plane as projecting piece 12 and barrel 7. The two stubs 16 make it possible to maintain cover 2 in its upright open position by respectively engaging in two recesses 17 in the bottom of housing 5. Preferably, cover 2 is maintained in its upright position at approximately 90° relative to the plane passing through the upper edge of rim 1*a* of frame 1.

Setting of the two stubs 16 by gravity in their respective recesses 17, when cover 2 has its male component 4 articulated in such a manner that it cannot be disassembled, in its housing 5 by hinge pin 8, is allowed by the fact that the diameter of bore 9 of cylindrical barrel 7 is larger than the diameter of hinge pin 8.

Of course, when one wishes to make articulation 3 removable relative to frame 1 in order to allow cover 2 to be extracted from the frame, hinge pin 8 is not present at all, and the two stubs 16 can also engage by gravity in their respective recesses when cover 2 is in its upright position in order to prevent it from tipping over in its frame.

The invention claimed is:

1. A manhole cover device comprising:

a frame having an opening and a peripheral rim surrounding the opening, the peripheral rim having an inside surface facing the opening and an outside surface opposed to the inside surface;

a cover articulated to the frame for moving the cover between a closed position, closing the opening of the frame, and an open position for accessing the opening of the frame;

a housing on the peripheral rim of the frame, the housing having two opposed substantially parallel end walls with respective holes, the holes being coaxial, the end walls forming a clevis and extending outward from the outside surface of the peripheral rim, wherein the holes in the end walls of the housing remain accessible from outside the manhole cover device after assembly of the manhole cover device, a connecting external wall transverse to, connected to, and connecting the two end walls to each other, the connecting external wall being located outside the rim, and a bottom wall transverse to and connected to the two end walls and the connecting wall and extending outwardly from the rim, and including two spaced apart recesses;

a male component extending from the cover and including a tubular barrel located in the housing and having a bore with an inside diameter, the barrel including respective stubs located at each of two ends of the barrel, the stubs projecting in a common plane from a single side of the barrel, perpendicular to the bore of the barrel, respective stubs engaging corresponding recesses in the bottom wall, by gravity, when the cover is in the open position, thereby holding the cover in the open position and preventing movement of the cover to the closed position; and a hinge pin having an outside diameter smaller than the inside diameter of the bore of the barrel and insertable in the bore of the barrel and the holes in the end walls of the housing, and attachable, at ends of the hinge pin, to the end walls of the housing, the outside diameter of the hinge pin being sufficiently smaller than the inside diameter of the bore so that, when the hinge pin is attached to the end walls, the cover cannot be removed from the frame, and the cover can be lifted, against gravity, relative to the hinge pin, to place the respective stubs into the corresponding recesses to hold the cover in the open position, preventing movement of the cover to the open position, and the cover can be lifted, against gravity, to remove the respective stubs from the corresponding recesses to move the cover from the open position to the closed position, and, when the hinge pin is not in the housing, the cover can be extracted from the frame.

2. The device according to claim 1, wherein the cover and the frame are circular.

3. The device according to claim 2, wherein the male component includes a projecting piece connected to and connecting the cover to the barrel, wherein the barrel is longer, along a direction aligned with the bore of the barrel, than the connecting piece so that the male component has a T-shape when viewed perpendicular to the bore and the cover.

4. The device according to claim 1, wherein the cover, in the open position, is approximately perpendicular to the frame.

5. The device according to claim 1, wherein the male component includes a projecting piece connected to and connecting the cover to the barrel, wherein the barrel is longer, along a direction aligned with the bore of the barrel, than the connecting piece so that the male component has a T-shape when viewed perpendicular to the bore and the cover.

* * * * *